US007674145B2

(12) United States Patent
Okuyama et al.

(10) Patent No.: US 7,674,145 B2
(45) Date of Patent: Mar. 9, 2010

(54) BOAT HAVING PRIORITIZED CONTROLS

(75) Inventors: Takashi Okuyama, Hamamatsu (JP); Makoto Ito, Hamamatsu (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 400 days.

(21) Appl. No.: 11/728,819

(22) Filed: Mar. 27, 2007

(65) Prior Publication Data

US 2007/0227429 A1 Oct. 4, 2007

(30) Foreign Application Priority Data

Mar. 28, 2006 (JP) ..... 2006-087325

(51) Int. Cl.
*B63H 5/125* (2006.01)

(52) U.S. Cl. ..... 440/61 T; 440/84

(58) Field of Classification Search ..... 440/84–87, 440/1, 61 T; 701/21; 74/480 B
See application file for complete search history.

(56) References Cited

U.S. PATENT DOCUMENTS

| | | | |
|---|---|---|---|
| 1,843,272 | A | 2/1932 | Ole Evinrude |
| 2,204,265 | A | 6/1940 | Wentzel |
| 2,466,282 | A | 4/1949 | Sparrow et al. |
| 2,740,260 | A | 4/1956 | Blanchard |
| 3,986,363 | A | 10/1976 | Beaman et al. |
| 4,412,422 | A | 11/1983 | Rossi |
| 4,493,662 | A | 1/1985 | Taguchi |
| 4,497,057 | A | 1/1985 | Kato et al. |
| 4,527,441 | A | 7/1985 | Nakahama |
| 4,549,869 | A | 10/1985 | Iida |
| 4,570,776 | A | 2/1986 | Iwashita |
| 4,579,204 | A | 4/1986 | Iio |
| 4,622,938 | A | 11/1986 | Wenstadt et al. |
| 4,646,696 | A | 3/1987 | Dogadko |
| 4,648,497 | A | 3/1987 | Prince |
| 4,708,669 | A | 11/1987 | Kanno et al. |
| 4,747,381 | A | 5/1988 | Baltz et al. |
| 4,755,156 | A | 7/1988 | Wagner |
| 4,788,955 | A | 12/1988 | Wood |
| 4,796,206 | A | 1/1989 | Boscove et al. |

(Continued)

FOREIGN PATENT DOCUMENTS

| | | |
|---|---|---|
| JP | 01-119499 | 5/1989 |

(Continued)

OTHER PUBLICATIONS

U.S. Appl. No. 11/731,681, filed Mar. 30, 2007, entitled Remote Control Apparatus for a Boat.

(Continued)

*Primary Examiner*—Ed Swinehart
(74) *Attorney, Agent, or Firm*—Keating & Bennett, LLP

(57) ABSTRACT

An outboard motor control system can have a first PTT switch and a second PTT switch in a first steering station and in a second steering station respectively, and a third PTT switch in a location outside of a boat hull. Operation instruction given by each PTT switch can be input to a first microcomputer of a first ECU. The first microcomputer can determine if the inputted operation instruction is to be sent to the outboard motor, based on which PTT switch the operation instruction came from, whether the main switch is ON or OFF, and which steering station has precedence in boat control.

20 Claims, 6 Drawing Sheets

U.S. PATENT DOCUMENTS 4,801,282 A 1/1989 Ogawa
4,805,396 A 2/1989 Veerhusen et al.
4,809,506 A 3/1989 Lauritsen
4,810,216 A 3/1989 Kawamura
4,822,307 A 4/1989 Kanno
4,836,809 A 6/1989 Pelligrino
4,843,914 A 7/1989 Korke
4,850,906 A 7/1989 Kanno et al.
4,858,585 A 8/1989 Remmers
4,898,045 A 2/1990 Baba
4,903,662 A 2/1990 Hirukawa
4,924,724 A 5/1990 Yoshimura
4,964,276 A 10/1990 Sturdy
4,973,274 A 11/1990 Hirukawa
5,004,962 A 4/1991 Fonss et al.
5,006,084 A 4/1991 Handa
5,050,461 A 9/1991 Onoue
5,051,102 A 9/1991 Onoue
5,059,144 A 10/1991 Onoue
5,062,403 A 11/1991 Breckenfeld et al.
5,062,516 A 11/1991 Prince
5,065,723 A 11/1991 Broughton et al.
5,072,629 A 12/1991 Hirukawa
5,076,113 A 12/1991 Hayasaka
5,103,946 A 4/1992 Masters et al.
5,127,858 A 7/1992 Pelligrino et al.
5,136,279 A 8/1992 Kanno
5,157,956 A 10/1992 Isaji et al.
5,167,212 A 12/1992 Peter et al.
5,201,238 A 4/1993 Hayasaka
5,231,890 A 8/1993 Hayasaka
5,245,324 A 9/1993 Jonker et al.
5,273,016 A 12/1993 Gillespie et al.
5,318,466 A * 6/1994 Nagafusa ..... 440/86
5,325,082 A 6/1994 Rodriguez
5,349,644 A 9/1994 Massey
5,381,769 A 1/1995 Nishigaki et al.
5,408,230 A 4/1995 Okita
5,445,546 A 8/1995 Nakamura
5,481,261 A 1/1996 Kanno
5,492,493 A 2/1996 Ohkita
5,539,294 A 7/1996 Kobayashi
5,556,312 A 9/1996 Ogino
5,556,313 A 9/1996 Ogino
5,575,698 A 11/1996 Ogino
5,595,159 A 1/1997 Huber et al.
5,597,334 A 1/1997 Ogino
5,633,573 A 5/1997 van Phuoc et al.
5,664,542 A 9/1997 Kanazawa et al.
5,687,694 A 11/1997 Kanno
5,692,931 A 12/1997 Kawai
5,697,821 A 12/1997 Ogino
5,730,105 A 3/1998 McGinnity
5,749,343 A 5/1998 Nichols et al.
5,771,860 A 6/1998 Bernardi
5,782,659 A 7/1998 Motose
5,788,546 A 8/1998 Ogino
5,827,150 A 10/1998 Mukumoto
5,839,928 A 11/1998 Nakayasu
5,852,789 A 12/1998 Trsar et al.
5,899,191 A 5/1999 Rabbit et al.
5,910,191 A 6/1999 Okamoto
5,935,187 A 8/1999 Trsar et al.
6,015,317 A 1/2000 Hoshiba et al.
6,015,319 A 1/2000 Tanaka
6,026,783 A 2/2000 Nestvall et al.
6,055,468 A 4/2000 Kaman et al.
6,058,349 A 5/2000 Kikori et al.
6,067,008 A 5/2000 Smith
6,067,009 A 5/2000 Hozuka et al.
6,073,509 A 6/2000 Salecker et al.
6,073,592 A 6/2000 Brown et al.
6,085,684 A 7/2000 Cotton
6,095,488 A 8/2000 Semeyn, Jr. et al.
6,098,591 A 8/2000 Iwata
6,102,755 A 8/2000 Hoshiba et al.
6,109,986 A 8/2000 Gaynor et al.
6,123,591 A 9/2000 Onoue
6,141,608 A 10/2000 Rother
6,174,264 B1 1/2001 Noshiba
6,217,400 B1 4/2001 Natsume
6,217,480 B1 4/2001 Iwata
6,233,943 B1 5/2001 Beacom et al.
6,273,771 B1 8/2001 Buckley et al.
6,280,269 B1 8/2001 Gaynor
6,351,704 B1 2/2002 Koerner
6,377,879 B2 4/2002 Kanno
6,379,114 B1 4/2002 Schott et al.
6,382,122 B1 5/2002 Gaynor et al.
6,414,607 B1 7/2002 Gonring et al.
6,529,808 B1 3/2003 Diem
6,536,409 B1 3/2003 Takahashi et al.
6,587,765 B1 7/2003 Graham et al.
6,599,158 B2 7/2003 Shidara et al.
6,612,882 B2 9/2003 Shidara et al.
6,691,023 B2 2/2004 Fujino et al.
6,704,643 B1 3/2004 Suhre et al.
6,751,533 B2 6/2004 Graham et al.
6,859,692 B2 2/2005 Okuyama
6,910,927 B2 6/2005 Kanno
6,965,817 B2 11/2005 Graham et al.
7,108,570 B2 9/2006 Okuyama
7,121,908 B2 10/2006 Okuyama
7,142,955 B1 11/2006 Kern et al.
7,153,174 B2 12/2006 Takada et al.
7,166,003 B2 1/2007 Motose
7,220,153 B2 5/2007 Okuyama
2001/0049579 A1 12/2001 Fujino et al.
2003/0060946 A1 3/2003 Okuyama et al.
2003/0060952 A1 3/2003 Kanno et al.
2003/0061076 A1 3/2003 Okuyama et al.
2003/0082962 A1 5/2003 Kanno
2003/0092331 A1 5/2003 Okuyama
2003/0093196 A1 5/2003 Okuyama
2004/0029461 A1 2/2004 Shomura
2005/0085141 A1 4/2005 Motose
2005/0118895 A1 6/2005 Kanno et al.
2005/0118896 A1 6/2005 Okuyama et al.
2005/0245145 A1 11/2005 Takada et al.
2005/0286539 A1 12/2005 Okuyama
2006/0240720 A1 10/2006 Yamashita et al.
2007/0082565 A1 4/2007 Okuyama
2007/0082566 A1 4/2007 Okuyama
2007/0178780 A1 8/2007 Ito et al.
2007/0218785 A1 9/2007 Okuyama
2007/0232162 A1 10/2007 Okuyama et al.
2007/0293102 A1 12/2007 Okuyama et al.

FOREIGN PATENT DOCUMENTS

JP 03-061196 3/1991
JP 07-133733 5/1995
JP 11-334694 12/1999
JP 2001-107752 4/2001
JP 2001-260986 9/2001
JP 2003-098044 4/2003
JP 2003-127986 5/2003
JP A-2003-146293 5/2003
JP 2004-036574 2/2004
JP 2004-068704 3/2004
JP 2004-244003 9/2004
JP 2004-286018 10/2004
JP 2005-161906 6/2005
JP 2005-297785 10/2005

WO WO 2005-102833 11/2005

OTHER PUBLICATIONS

U.S. Appl. No. 11/731,691, filed Mar. 30, 2007, entitled Remote Control System for a Watercraft.
U.S. Appl. No. 11/731,057, filed Mar. 30, 2007, entitled Remote Control Unit for a Boat.
U.S. Appl. No. 11/731,422, filed Mar. 30, 2007, entitled Remote Control System for a Boat.
U.S. Appl. No. 11/731,086, filed Mar. 30, 2007, entitled Remote Control Device for a Boat.
Product catalog of i6000TEC—Triple Engine Electronic Shift & throttle of Teleflex Morse Co., Ltd. (USA), Jul. 2000.
Barron, Jim. "Get on the Bus." Trailer Boats Magazine, Jun. 2000, p. 36.
Spisak, Larry. "Know it by Chart." Boating Magazine, May 2000, p. 100.
J.D. "Gains in technology will alter makeup of the . . . " Boating Industry International, Nov. 2000.
Denn, James. "Future boats sales will hinge on technology." Boating Industry International, Nov. 2000.
Hemmel, Jeff. "Information, Please—The digital boating resolution begins." Boating Magazine, Sep. 2000.
Kelly, Chris. "Can We Talk?" Power & Motoryacht Magazine, Jun. 2000, pp. 36 & 38, 39.
"Plug and Play" Advertisement from "Motorboating", Dec. 2000, p. 57.
Search Report for PCT/JP 2005/00175, mailed Mar. 1, 2005.

* cited by examiner

27d1

(a) When the main switch is OFF

| | Input data | | | | | | Output data | PTT operation |
|---|---|---|---|---|---|---|---|---|
| | (1) First PTT switch | | (2) Second PTT switch | | (3) Third PTT switch | | | |
| | PTT UP SW | PTT DOWN SW | PTT UP SW | PTT DOWN SW | PTT UP SW | PTT DOWN SW | | |
| 1-1 | OFF→ ON | - | - | - | - | - | (1) Output | UP |
| | - | OFF→ ON | - | - | - | - | (1) Output | DOWN |
| 1-2 | - | - | OFF→ ON | - | - | - | (2) Shut off | OFF |
| | - | - | - | OFF→ ON | - | - | (2) Shut off | OFF |
| 1-3 | - | - | - | - | OFF→ ON | - | (3) Output | UP |
| | - | - | - | - | - | OFF→ ON | (3) Output | DOWN |
| 1-4 | OFF→ ON | - | - | OFF→ ON | - | - | (1) Output, (2) Shut off | UP |
| | - | OFF→ ON | OFF→ ON | - | - | - | (1) Output, (2) Shut off | DOWN |
| 1-5 | OFF→ ON | - | - | - | - | OFF→ ON | (1)(3) Shut off | OFF |
| | - | OFF→ ON | - | - | OFF→ ON | - | (1)(3) Shut off | OFF |
| 1-6 | - | - | OFF→ ON | - | - | OFF→ ON | (3) Output, (2) Shut off | DOWN |
| | - | - | - | OFF→ ON | OFF→ ON | - | (3) Output, (2) Shut off | UP |

*Figure 4*

27d2

(b) When the main switch is ON, and the operating station selector switch on the first key switch assembly is ON

| | Input data | | | | | | Output data | PTT operation |
|---|---|---|---|---|---|---|---|---|
| | (1) First PTT switch | | (2) Second PTT switch | | (3) Third PTT switch | | | |
| | PTT UP SW | PTT DOWN SW | PTT UP SW | PTT DOWN SW | PTT UP SW | PTT DOWN SW | | |
| 2-1 | OFF→ ON | - | - | - | - | - | (1) Output | UP |
| | - | OFF→ ON | - | - | - | - | (1) Output | DOWN |
| 2-2 | - | - | OFF→ ON | - | - | - | (2) Shut off | OFF |
| | - | - | - | OFF→ ON | - | - | (2) Shut off | OFF |
| 2-3 | - | - | - | - | OFF→ ON | - | (3) Output | UP |
| | - | - | - | - | - | OFF→ ON | (3) Output | DOWN |
| 2-4 | OFF→ ON | - | - | OFF→ ON | - | - | (1) Output, (2) Shut off | UP |
| | - | OFF→ ON | OFF→ ON | - | - | - | (1) Output, (2) Shut off | DOWN |
| 2-5 | OFF→ ON | - | - | - | - | OFF→ ON | (1)(3) Shut off | OFF |
| | - | OFF→ ON | - | - | OFF→ ON | - | (1)(3) Shut off | OFF |
| 2-6 | - | - | OFF→ ON | - | - | OFF→ ON | (3) Output, (2) Shut off | DOWN |
| | - | - | - | OFF→ ON | OFF→ ON | - | (3) Output, (2) Shut off | UP |

*Figure 5*

27d3

(c) When the main switch is ON, and the operating station selector switch on the second key switch assembly is ON

| | Input data | | | | | | Output data | PTT operation |
|---|---|---|---|---|---|---|---|---|
| | (1) First PTT switch | | (2) Second PTT switch | | (3) Third PTT switch | | | |
| | PTT UP SW | PTT DOWN SW | PTT UP SW | PTT DOWN SW | PTT UP SW | PTT DOWN SW | | |
| 3-1 | OFF→ ON | - | - | - | - | - | (1) Shut off | OFF |
| | - | OFF→ ON | - | - | - | - | (1) Shut off | OFF |
| 3-2 | - | - | OFF→ ON | - | - | - | (2) Output | UP |
| | - | - | - | OFF→ ON | - | - | (2) Output | DOWN |
| 3-3 | - | - | - | - | OFF→ ON | - | (3) Output | UP |
| | - | - | - | - | - | OFF→ ON | (3) Output | DOWN |
| 3-4 | OFF→ ON | - | - | OFF→ ON | - | - | (2) Output, (1) Shut off | DOWN |
| | - | OFF→ ON | OFF→ ON | - | - | - | (2) Output, (1) Shut off | UP |
| 3-5 | OFF→ ON | - | - | - | - | OFF→ ON | (3) Output, (1) Shut off | DOWN |
| | - | OFF→ ON | - | - | OFF→ ON | - | (3) Output, (1) Shut off | UP |
| 3-6 | - | - | OFF→ ON | - | - | OFF→ ON | (2)(3) Shut off | OFF |
| | - | - | - | OFF→ ON | OFF→ ON | - | (2)(3) Shut off | OFF |

*Figure 6*

BOAT HAVING PRIORITIZED CONTROLS

CROSS-REFERENCE TO RELATED APPLICATIONS

This application is based on and claims priority under 35 U.S.C. §119 to Japanese Patent Application No. 2006-087325, filed on Mar. 28, 2006, the entire contents of which is hereby expressly incorporated by reference herein.

BACKGROUND OF THE INVENTIONS

1. Field of the Inventions

The present inventions relate to boats having boat propulsion units, such as outboard motors, and more specifically to control of boat propulsion units in accordance with control signals transmitted by an onboard device or devices.

2. Description of the Related Art

Outboard motors mounted on the outside of boats are used for providing propulsion and steering functions for boats. In recent years, onboard LAN systems have been developed to replace outboard motors' throttle control mechanism operated via the cables installed onboard. An example of such a system is disclosed in Japanese Patent Document JP-A-2003-146293. The onboard LAN system connects the outboard motor and the hull by means of a LAN (Local Area Network), and controls the outboard motor by control signals transmitted by an onboard device. The onboard LAN system allows connection of many devices to one cable, simplifying the wiring between the hull and the outboard motor. A PTT (Power Trim and Tilt) switch is also connected to the onboard LAN to control the trim and tilt angles of the outboard motor.

SUMMARY OF THE INVENTIONS

An aspect of at least one of the embodiments disclosed herein includes the realization that in boats having plural PTT switches (for instance, when a PTT switch is provided at each steering/control station in a boat having plural steering/control stations, or when a separate PTT switch is provided in a location outside of the hull), the trim and tilt angle operation commands input by each PTT switch can be processed to prevent outboard motor operation that was not intended by a boat operator or by a helmsman, or to prevent malfunction of the outboard motor.

Thus, in accordance with at least one of the embodiments disclosed herein, a boat can comprise an outboard motor operating means having a first steering station and a second steering station and connected to a boat propulsion unit, a plurality of operation instruction output means for transmitting to the outboard motor operating means operation instructions for controlling the trim and tilt angles of the boat propulsion unit, and an operation instruction selecting means for selecting the operation instructions transmitted by the plurality of operation instruction output means and for sending the selected operation instruction to the boat propulsion unit. The plurality of operation instruction output means can include a first operation instruction output means mounted at the first steering station, a second operation instruction output means mounted at the second steering station, and a third operation instruction output means mounted on the outer surface of the boat propulsion unit or on a hull of the boat. The operation instruction selecting means can prioritize the first operation instruction output means, the second operation instruction output means, and the third operation instruction output means, to process the operation instructions in accordance with the priority given to each means.

In accordance with at least one of the embodiments disclosed herein, a boat comprises a propulsion unit, a first control station, a second control station, a control unit, a first switch mounted at the first control station, and a second switch mounted at the second control station. The first and second switches are configured to transmit operation instructions to control the trim and tilt angles of the propulsion unit. The control unit is configured to process the operation instructions transmitted by the first and second switches based on a priority given to each switch and to send operation instructions to the propulsion unit to control the trim and tilt angles of the propulsion unit.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit, the inventions. The drawings contain the following figures:

FIG. 4 is a table showing a relationship between operation instruction inputs and operation instruction outputs that can be stored as a first table in an operation instruction output-information memory.

FIG. 5 is a table showing a relationship between operation instruction inputs and operation instruction outputs that can be stored as a second table in an operation instruction output-information memory.

FIG. 6 is a table showing a relationship between operation instruction inputs and operation instruction outputs that can be stored as a third table in an operation instruction output-information memory.

DETAILED DESCRIPTION OF THE PREFERRED EMBODIMENTS

Figure 1:
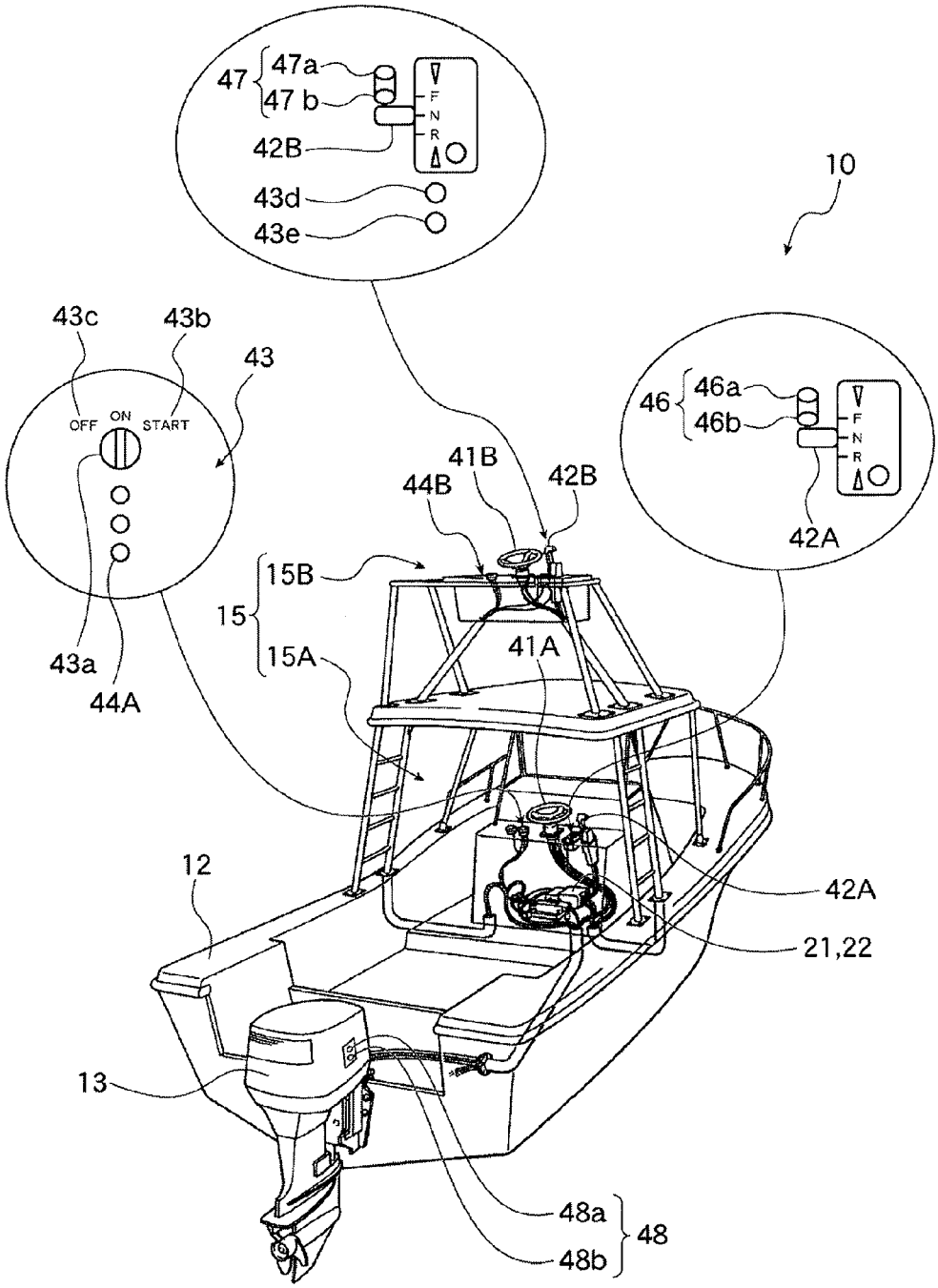
FIG. 1 is a perspective view of a boat according to an embodiment.

FIG. 1 is a perspective view of a boat 10 according to an embodiment. The embodiments disclosed herein are described in the context of a boat having an outboard motor because these embodiments have particular utility in this context. However, the embodiments and inventions herein can also be applied to other marine vessels having other types of propulsion systems, including personal watercraft and small jet boats, as well as other land and marine vehicles. It is to be understood that the embodiments disclosed herein are exemplary but non-limiting embodiments, and thus, the inventions disclosed herein are not limited to the disclosed exemplary embodiments.

As shown in FIG. 1, the boat 10 can include a hull 12 and a propulsion unit, such as an outboard motor 13. Two control stations, also referred to as steering stations 15, can be provided on the hull 12. A first steering station 15A can be assigned as a main steering station, and a second steering station 15B can be assigned as a sub station. In the illustrated embodiment, each of the steering stations 15A, 15B is equipped with a steering wheel 41A, 41B, and a shift lever 42A, 42B. In other embodiments, more or less control equipment can be provided at one or more control stations. The boat 10 can be controlled either at the first steering station 15A or at the second steering station 15B.

A rotary switch 43, which can be rotated by an ignition key (not shown) inserted therein, can be located at the first steering station 15A. The rotary switch 43 can function as a main switch 43*a* configured to select an ON or OFF status of the engine by inserting or removing the ignition key (not shown), as well as a starting switch 43*b* and a stop switch 43*c* set up at two different rotational positions. A push button type starting switch 43*d* and a stop switch 43*e* can be provided at the second steering station 15B. The switches described herein can be push button, toggle, rotary or other types of switches known to those of skill in the art.

Push button-type steering station selector switches 44A, 44B can be provided at the first steering station 15A and at the second steering station 15B, respectively. Control of the boat can be given selectively to the first steering station 15A or to the second steering station 15B by actuating the steering station selector switch 44A, 44B.

In addition, a first PTT (power trim and tilt) switch (a first operation instruction output means) 46 can be provided in the vicinity of the shift lever 42A at the first steering station 15A, a second PTT switch (a second operation instruction output means) 47 can be provided in the vicinity of the shift lever 42B at the second steering station 15B, and a third PTT switch (a third operation instruction output means) 48 can be provided on an external surface of the outboard motor 13 or on the hull of the boat, respectively. Each of these first, second, and third PTT switches 46, 47, 48 can be used to input operation instructions for moving the outboard motor 13 up (UP instruction) and for moving it down (DOWN instruction) in order to adjust tilt and trim. Thus, each of the switches 46, 47, 48 can have an UP switch 46*a*, 47*a*, 48*a*, respectively, to input an UP instruction, and a DOWN switch 46*b*, 47*b*, 48*b*, respectively, to input a DOWN instruction. The UP switches 46*a*, 47*a*, 48*a*, and DOWN switches 46*b*, 47*b*, 48*b* can be push buttons. Operation instruction output can continue while the switch is actuated, and the output can cease once the switch is released.

Figure 2:
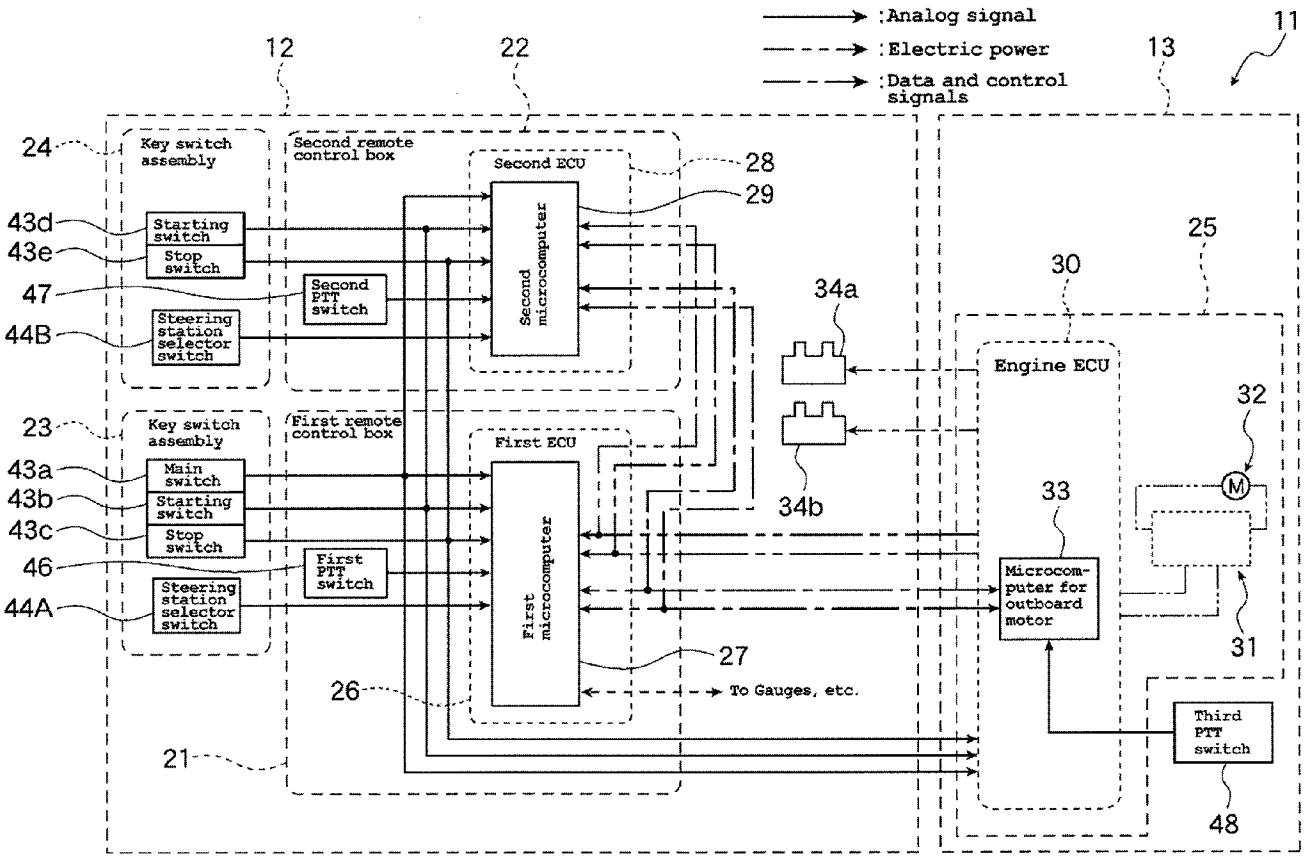
FIG. 2 is a block diagram of an outboard motor control system according to one embodiment.

FIG. 2 is a block diagram of an outboard motor control system 11 according to one embodiment. As shown in FIG. 2, the outboard motor control system 11 can be an inboard network system provided in the boat 10 for the purpose of DBW (Drive-By-Wire) operation. The outboard motor control system 11 can comprise a first remote control box 21 serving as a main remote control device, a second remote control box 22 serving as a sub remote control device, a first key-switch assembly 23, and a second key-switch assembly 24, all provided on the boat 12, as well as outboard motor equipment (an outboard motor operating means) 25 mounted on the outboard motor 13, which can be connected by CAN (Controller Area Network) to allow communication with each other. In the aforementioned CAN, connection between the first remote control box 21 and the second remote control box 22, as well as the connection between the first remote control box 21 and the outboard motor equipment 25 can be constructed as double connections. While the network is operating normally, one of the connections can serve as a main connection primarily handling data communication, while the other can serve as a sub connection primarily handling communication of control signals. It should be noted that the CAN can be constructed either by wire communication or by wireless communication using infra-red radiation, radio waves, supersonic wave, or other means known to those of skill in the art.

The first remote control box 21 can have a first ECU (Engine Control Unit) 26 and a first PTT switch 46.

The first ECU 26 can be connected to the first PTT switch 46 and various sensors, which are not shown in the diagram. In addition, the first ECU 26 can have a first microcomputer (steering station selector means, operation instruction selecting means) 27, which can control operation of the boat 10 based on the input signals from the switches and sensors connected to it. The first ECU 26 also can monitor the signals and data processing of the entire outboard motor control system 11 by the connections, to the second remote control box 22 and the outboard motor equipment 25.

The second remote control box 22 can have a second ECU 28 and a second PTT switch 47. The second ECU 28 can be connected to the second PTT switch 47 and various sensors, which are not shown in the diagram. In addition, the second ECU 28 can have a second microcomputer (steering station selector means, operation instruction selecting means) 29 which can control the boat 10 in cooperation with the first microcomputer 27 and under the monitoring and control of the first microcomputer 27.

The first key switch assembly 23 can include plural devices including the main switch 43*a*, the starting switch 43*b*, the stop switch 43*c*, and the steering station selector switch 44A configured to input instructions to the first microcomputer 27 and to implement the instructions in accordance with control by the first microcomputer 27.

The second key switch assembly 24 can have plural devices including the starting switch 43*d*, the stop switch 43*e*, and the steering station selector switch 44B configured to input instructions to the second microcomputer 29 and to implement the instructions in accordance with control by the second microcomputer 29.

The outboard motor equipment 25 can include an engine (not shown) and devices for driving the engine (not shown) as commanded by the boat operator. For example, the outboard motor equipment 25 can include various sensors. The outboard motor equipment 25 also can include an engine ECU 30, a PTT relay 31, a PTT motor 32, and a third PTT switch 48.

The engine ECU 30 can handle the control of the outboard motor 13. The engine ECU 30 can be provided with an outboard-motor-mounted microcomputer 33 configured to control the operation of the engine (not shown) and various associated devices in accordance with the operation instructions received. The outboard-motor-mounted microcomputer 33 also can output a signal to control the operation of the PTT relay 31 and the PTT motor 32. The PTT motor 32 can adjust a trim angle and a tilt angle of the outboard motor 13 by exerting a rotational force to the mounting axis (not shown) where the outboard motor 13 is mounted to the hull 12 and making the outboard motor 13 rotate relative to the hull 12. Electric power generated by the engine (not shown) during operation can be supplied to a main battery 34*a* and a sub buttery 34*b*. The third PTT switch 48, connected to the outboard-motor-mounted microcomputer 33, can input the operation instruction for trim angles and the tilt angles to the outboard-motor-mounted microcomputer 33.

Figure 3:
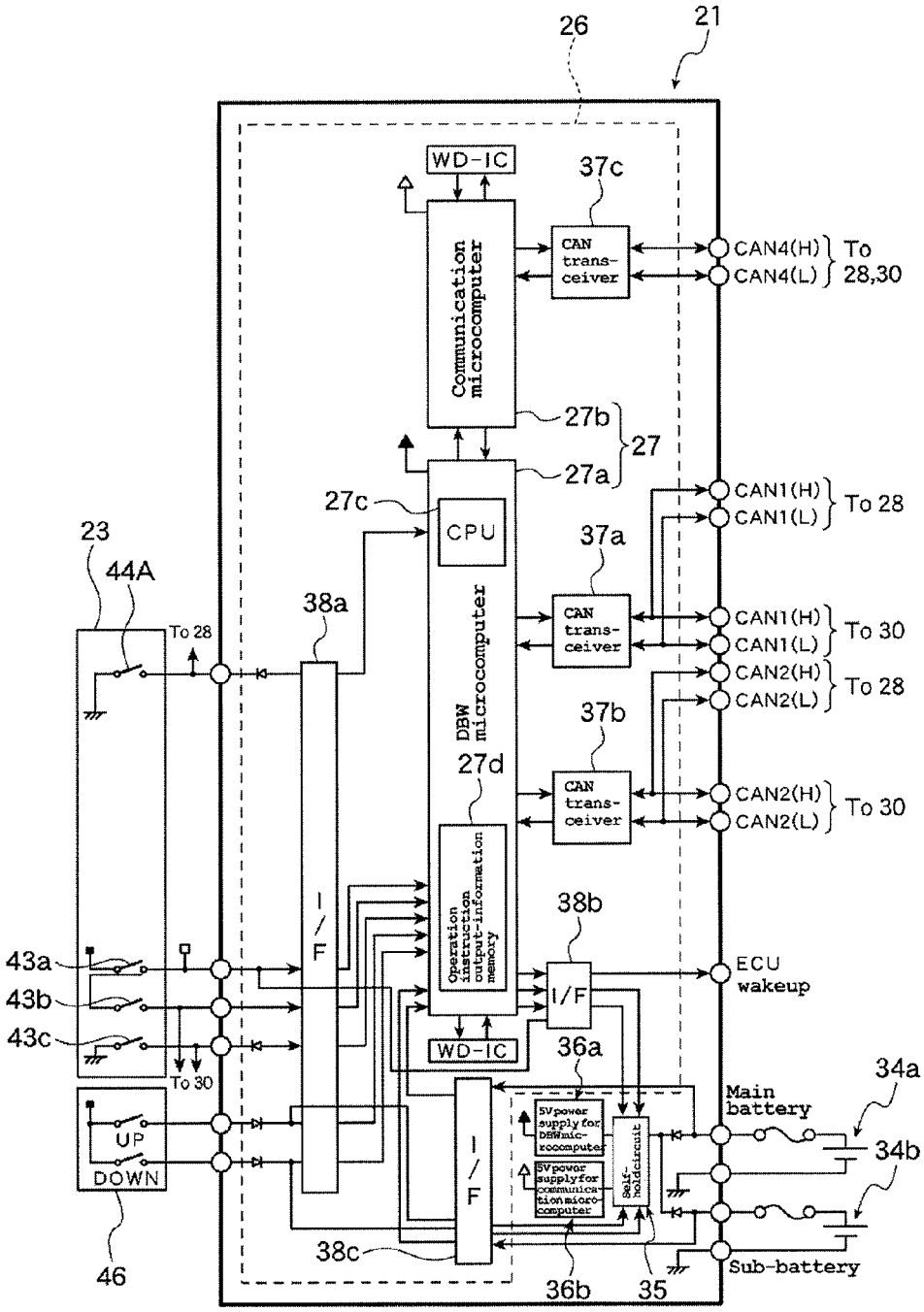
FIG. 3 is a block diagram showing the first remote control box section of the outboard motor control system of FIG. 2.

As shown in FIG. 3, the first ECU 26 of the first remote control box 21 can include, in addition to the configuration shown in FIG. 2, CAN transceivers 37*a*, 3*b*, 37*c* to process communications between the first microcomputer 27 and the second microcomputer 29, and between the first microcomputer 27 and the outboard-motor-mounted microcomputer 33. The first ECU 26 further can include interfaces 38*a*, 38*b*, 38*c* to perform processing associated with communication with the peripheral devices connected to the first ECU 26. The main battery 34*a*, the sub battery 34*b*, a self-hold circuit 35, and 5V power supplies 36*a*, 36*b* can be among the peripheral devices connected to the first ECU 26 in addition to the configuration shown in FIG. 2.

The first microcomputer 27 of the first remote control box 21 can include a DBW microcomputer 27*a* and a communication microcomputer 27*b*. The DBW microcomputer 27*a* can be a main microcomputer and mainly handle data communication. The communication microcomputer 27*b* can be a sub microcomputer and mainly handle control signal communication.

The DBW microcomputer 27*a* can have a CPU (Central Processing Unit) 27*c* and an operation instruction output-information memory 27*d*. The CPU 27*c* can implement instructions and process data. The operation instruction output-information memory 27*d* can store information that can be used to select the operation instruction output to control the trim and tilt angles of the outboard motor 13, based on the relevant input from the first, second and third PTT switches 46, 47, 48. The operation instruction output-information memory 27*d* can be configured in a nonvolatile storage device such as a hard disk or other auxiliary storage that can retain the information stored in the memory after the power supply to the outboard motor control system 11 is turned off, for example when the main switch 43*a* is turned off. The information stored in the operation instruction output-information memory 27*d* will be described further below.

The main battery 34*a* can be the primary power source of the first microcomputer 27, while the sub battery 34*b* can be a backup power source. Each battery can supply electric power to the first microcomputer 27. Also, the main battery 34*a* and the sub battery 34*b* can supply electric power to nodes other than the first microcomputer 27 of the outboard motor control system 11, such as the second microcomputer 29 and the outboard-motor-mounted microcomputer 33.

The self-hold circuit 35 can be interposed between the batteries 34*a*, 34*b* and the first microcomputer 27 to maintain electrical continuity for a prescribed period of time, for example, a prescribed period of time after the release of the first, second or third PTT switch 46, 47, 48 that has been actuated.

The DBW microcomputer 27*a* can be connected to an ECU wakeup device (not shown). The ECU wakeup device (not shown) can supply power to the engine ECU 30 to activate it when either the main switch 43*a* or the first PTT switch 46 is turned on.

The 5V power supply 36*a* can be connected to the self-hold circuit 35 and the DBW microcomputer 27*a*, while the 5V power supply 36*b* can be connected to the self-hold circuit 35 and the communication microcomputer 27*b*, to supply electric power for driving the DBW microcomputer 27*a* and the communication microcomputer 27*b* respectively while the self-hold circuit 35 maintains electrical continuity.

The first microcomputer 27 can output signals to control the trim and tilt angles of the outboard motor 13 based on the operation instruction input from the first, second, or third PTT switch 46, 47, 48. Operation instructions from the second PTT switch 47 and the third PTT switch 48, can be transmitted to the first microcomputer 27 by the second microcomputer 29 and outboard-motor-mounted microcomputer 33, respectively. Then, the first microcomputer 27 can transmit the operation instructions to the outboard-motor-mounted microcomputer 33, upon which the trim and tilt angles can be controlled.

In this process, the first microcomputer 27 can determine if the operation instruction in question is to be transmitted, or which operation instruction is to be transmitted to the outboard-motor-mounted microcomputer 33, based on which PTT switch or switches input the operation instructions, whether the main switch 43*a* is ON or OFF, and which of the first steering station 15A and the second steering station 15B has precedence in boat control. Before making a determination, the first microcomputer 27 can refer to the information stored in the operation instruction output-information memory 27*d* and evaluate the stored information and the factors described above.

FIGS. 4 through 6 are tables showing relationships between the operation instruction input received by the first microcomputer 27 and the operation instruction output from the first microcomputer 27, which can be stored in the operation instruction output-information memory 27*d* of the outboard motor control system 11 according to an embodiment. As shown in these tables, the relationships can be stored in tables depending on whether the main switch 43*a* is ON or OFF, and on the status of the starting switch 43*b* and the stop switch 43*c* on the first remote control box 21, and the starting switch 43*d* and the stop switch 43*e* on the second remote control box 22, in other words, which steering station has precedence in boat control, the first steering station 15A or the second steering station 15B.

Referring to FIGS. 4-6, methods of the processing of the operation instructions input by the first, second, or third PTT switch 46, 47 48 are described below.

Information relating to a relationship between the operation instruction input and the operation instruction output when the main switch 43*a* is OFF can be stored as a first table 27$d_1$ as shown in FIG. 4.

The self-hold circuit 35, upon receiving the operation instruction from the first PTT switch 46 (first operation instruction), the second PTT switch 47 (second operation instruction) or the third PTT switch 48 (third operation instruction), can establish electrical continuity to activate the 5V power supplies 36*a*, 36*b*, thereby supplying electrical power to the DBW microcomputer 27*a*, and to the communication microcomputer 27*b* which would otherwise not be supplied with electrical power. Thus, the first microcomputer 27, the second microcomputer 29 and the outboard-motor-mounted microcomputer 33 can be activated to carry out PTT operation. After a predetermined time period (for example, a short period of time such as several seconds) from the release of the first PTT switch 46, the second PTT switch 47, or the third PTT switch 48 that has been actuated, the electrical continuity of the self-hold circuit 35 can cease and the electrical power from the 5V power supplies 36*a* and 36*b* can be shut off. Thus, the first microcomputer 27, the second microcomputer 29 and the outboard-motor-mounted microcomputer 33 stop their operation. Thus, PTT operation can be enabled while the main switch 43*a* is OFF by using the 5V power supplies 36*a*, 36*b*.

When the main switch 43*a* is OFF, equal priority can be given to the operation instructions from the first PTT switch 46 and those from the third PTT switch 48, while lower priority can be given to the operation instructions from the second PTT switch 47 relative to those from the first and the third PTT switches 46, 48.

The DBW microcomputer 27*a* of the first microcomputer 27 can verify that the main switch 43*a* is OFF and can identify whether operation instruction came from the first, second, or third PTT switch 46, 47, 48. Then, the DBW microcomputer 27*a* can refer to the information stored in the first table 27$d_1$, and can determine which operation instruction is to be transmitted to the outboard-motor-mounted microcomputer 33, or that all of the operation instructions are to be cut off.

Referring to row 1-1 of FIG. 4, when the operation instruction is input by the first PTT switch 46 only, the first microcomputer 27 can transmit the operation instruction to the outboard-motor-mounted microcomputer 33 regardless of whether the instruction is an UP instruction or a DOWN instruction (as can also be the case in the processing described below), followed by implementation of trim and tilt angle control of the outboard motor 13 according to the transmitted operation instruction. This can enable trim and tilt angle control by the first PTT switch 46 at the first steering station even when the main switch is OFF. Thus, during maintenance, for example, the trim and tilt angles can be controlled from the first steering station, even when the main switch is OFF. This can enable the trim and tilt angle control using the PTT switch at the first steering station even when the main switch is OFF, under the condition that priority is given to the operation instruction from the first steering station, such as when the first steering station is assigned as the main steering station. Thus, controllability of the trim and tilt angles can be improved by the priority given to the first steering station.

When the operation instruction is input by the second PTT switch 47 only, the first microcomputer 27 can cut off the operation instruction transmitted by the second microcomputer 29 without sending it to the outboard-motor-mounted microcomputer 33. Consequently, implementation of trim and tilt angle control of the outboard motor 13 can be prevented (Refer to (1-2)). Thus, adverse effects on trim and tilt angle control of the outboard motor 13 can be avoided by the priority given to the second steering station 15B, such as when the second steering station 15B is assigned as the sub steering station.

When the operation instruction is input by the third PTT switch 48 only, the first microcomputer 27 can transmit the operation instruction to the outboard-motor-mounted microcomputer 33, followed by implementation of trim and tilt angle control of the outboard motor 13 according to the transmitted operation instruction (Refer to (1-3)). This can enable trim and tilt angle control using the third PTT switch 48, located on the external surface of the outboard motor 13 or exterior of the hull, even when the main switch is OFF. Thus, during maintenance, for example, the trim and tilt angles can be controlled from the outside of the boat propulsion unit or from the hull as may be necessary, even when the main switch is OFF. This can improve the controllability of trim and tilt angles from the outside of the boat propulsion unit or from the hull.

When the operation instructions are input simultaneously by the first PTT switch 46 and the second PTT switch 47, the first microcomputer 27 can cut off the operation instruction from the second PTT switch 47, and transmit the operation instruction from the first PTT switch 46 to the outboard-motor-mounted microcomputer 33 (Refer to (1-4)). Thus, the operation instruction from the first PTT switch 46 can have a higher priority than the operation instruction from the second PTT switch 47, and can allow trim and tilt angle control of the outboard motor 13 based on the aforementioned priority. The first steering station 15A can be assigned as the main steering station, and the second steering station 15B can be assigned as the sub steering station. The first steering station 15A (main steering station) can have precedence in boat control over the second steering station 15B (sub steering station), and such prioritized configuration of both steering stations 15A, 15B can be utilized to prevent trim and tilt angle control that was not intended by a boat operator or a helmsman.

With continued reference to FIG. 4, when the operation instruction is input simultaneously by the first PTT switch 46 and by the third PTT switch 48, the first microcomputer 27 can cut off both the operation instructions transmitted from the first and the third PTT switches 46, 48, without transmitting any operation instruction to the outboard-motor-mounted microcomputer 33 (Refer to (1-5)). This can prevent unintended operation of the outboard motor 13 when conflicting operation instructions are input simultaneously from the first steering station 15A and from the outboard motor 13 while the operation instruction input from the outboard motor 13 is enabled, during maintenance, for example.

When the operation instructions are input simultaneously by the third PTT switch 48 and the second PTT switch 47, the first microcomputer 27 can cut off the operation instruction from the second PTT switch 47, and transmit only the operation instruction from the third PTT switch 48 to the outboard-motor-mounted microcomputer 33 (Refer to (1-4) and (1-6)). Thus, adverse effects on trim and tilt angle control of the outboard motor 13 can be avoided by the priority given to the second steering station 15B, such as when the second steering station 15B is assigned as the sub steering station, and trim and tilt angle control of the outboard motor 13 from the outside of the outboard motor 13 can be improved.

In one preferred embodiment, information relating to a relationship between the operation instruction input and the operation instruction output when the main switch 43*a* is ON and the operating station selector switch 44A on the first key switch assembly 23 is ON can be stored in a second table 27$d_2$ as shown in FIG. 5.

Just as when the main switch 43*a* is OFF, equal priority can be given to the operation instructions from the first PTT switch 46 and those from the third PTT switch 48, while lower priority can be given to the operation instructions from the second PTT switch 47 relative to those from the first and the third PTT switches 46, 48.

When the operation instruction is input by the first, second, or third PTT switch 46, 47, or 48, the DBW microcomputer 27*a* of the first microcomputer 27 can identify the PTT switch from which the operation instruction came, and check which steering station, e.g., the first steering station 15A or the second steering station 15B, has precedence in boat control. Then, the DBW microcomputer 27*a* can refer to the information stored in the second table 27$d_2$ and determine which operation instruction is to be transmitted to the outboard-motor-mounted microcomputer 33, or that all of the operation instructions are to be cut off.

When the operation instruction is input by the first PTT switch 46 only, or by the third PT switch 48 only, the first microcomputer 27 can transmit the relevant operation instruction to the outboard-motor-mounted microcomputer 33 (Refer to (2-1) and (2-3)). Thus, controllability of trim and tilt angles of the outboard motor 13 can be improved by giving precedence in boat control to the first steering station 15A, and during maintenance, for example, trim and tilt angle control of the outboard motor 13 from the outside of the outboard motor 13 can be improved.

With continued reference to FIG. 5, when the operation instruction is input by the second PTT switch 47 only, the first microcomputer 27 can cut off the operation instruction without sending it to the outboard-motor-mounted microcomputer 33 (Refer to (2-2)). Thus, adverse effects on the trim and tilt angle control of the boat propulsion unit can be avoided by the second steering station not having precedence in boat control.

When the operation instructions are input simultaneously by the first PTT switch 46 and the second PTT switch 47, or by the third PTT switch 48 and the second PTT switch 47, the first microcomputer 27 can transmit only the operation instructions by the first and third PTT switches 46, 48 to the outboard-motor-mounted microcomputer 33 (Refer to (2-4), (2-6)). Thus, the implementation of trim and tilt angle control by the operation instruction from the second steering station 15B, which does not have precedence in boat control, can be prevented, as such operation instruction is not intended by a boat operator or a helmsman. In addition, controllability of the trim and tilt angle of the outboard motor 13 can be improved further by the first steering station 15A having precedence in boat control, or by the control of the outboard motor 13 provided from the outer surface.

With continued reference to FIG. 5, when the operation instruction is input simultaneously by the first PTT switch 46 and the third PTT switch 48, the first microcomputer 27 can cut off both operation instructions transmitted by the first and the third PTT switches 46, 48, without transmitting any operation instruction to the outboard-motor-mounted microcomputer 33 (Refer to (2-5)). Thus, when the conflicting operation instructions are input simultaneously to the outboard-motor-mounted microcomputer 33 from the outboard motor 13 and the first steering station 15A, which has precedence in boat control, trim and tilt angle control that was essentially not intended by a boat operator or a helmsman can be prevented.

Note that electric power from the main battery 34*a* and the sub battery 34*b* can be supplied to the first microcomputer 27 or related devices while the main switch 43*a* is ON. Therefore, unlike the aforementioned cases from FIG. 5 in which the main switch 43A is OFF, the first microcomputer 27 can function without power being supplied by the 5V power supplies 36*a*, 36*b*.

Information relating to a relationship between the operation instruction input and the operation instruction output when the main switch 43*a* is ON and the operating station selector switch 44B on the second key switch assembly 24 is ON can be stored in a third table 27$d_3$ as shown in FIG. 6.

In this case, the prioritization regarding the operation instructions from the first PTT switch 46 and those from the second PTT switch 47 can be inverted from the cases stored in the first table 27$d_1$ and the second table 27$d_2$. Specifically, equal priority can be given to the operation instructions from the second PTT switch 47 and those from the third PTT switch 48, while lower priority is given to the operation instructions from the first PTT switch 46 relative to those from the second and the third PTT switches 47, 48.

In this case, too, when the operation instruction is input by the first, second, or third PTT switch 46, 47, or 48, the DBW microcomputer 27*a* of the first microcomputer 27 can identify the PTT switch from which the operation instruction came, and check which steering station, e.g., the first steering station 15A or the second steering station 15B, has precedence in boat control. Then, the DBW microcomputer 27*a* can refer to the information stored in the third table 27$d_3$, and determine which operation instruction is to be transmitted to the outboard-motor-mounted microcomputer 33, or that all of the operation instructions are to be cut off.

With continued reference to FIG. 6, when the operation instruction is input by the second PTT switch 47 only, or by the third PTT switch 48 only, the first microcomputer 27 can transmit the relevant operation instruction to the outboard-motor-mounted microcomputer 33 (Refer to (3-2) and (3-3)). Thus, controllability of trim and tilt angles of the outboard motor 13 can be improved by the second steering station 15B having precedence in boat control, and during maintenance, for example, controllability of trim and tilt angle of the outboard motor 13 from the outside of the outboard motor 13 can be improved.

When the operation instruction is input by the first PTT switch 46 only, the first microcomputer 27 can cut off the relevant operation instruction without sending it to the outboard-motor-mounted microcomputer 33 (Refer to (3-1)). Thus, adverse effects on the trim and tilt angle control of the boat propulsion unit can be avoided by the first steering station not being given precedence in boat control.

When the operation instructions are input simultaneously by the second PTT switch 47 and the first PTT switch 46, or by the third PTT switch 48 and the first PTT switch 46, the first microcomputer 27 can cut off the operation instruction by the first PTT switch 46, and transmit the operation instructions by the second and third PTT switches 47, 48 to the outboard-motor-mounted microcomputer 33 (Refer to (3-4), (3-5)). Thus, the implementation of trim and tilt angle control by the operation instruction from the first steering station 15A, which does not have precedence in boat control, can be prevented, as such operation instruction is not intended by a boat operator or a helmsman. In addition, controllability of trim and tilt angles of the outboard motor 13 can be improved further by the second steering station 15B being given precedence in boat control, or by the control of the outboard motor 13 provided from the outer surface.

When the operation instructions are input simultaneously by the second PTT switch 47 and the third PTT switch 48, the first microcomputer 27 can cut off both operation instructions transmitted by the second and the third PTT switches 47, 48, without transmitting any operation instruction to the outboard-motor-mounted microcomputer 33 (Refer to (3-6)). Thus, when conflicting operation instructions are input simultaneously to the first microcomputer 27 from the outboard motor 13 and the second steering station 15B, which has precedence in boat control, trim and tilt angle control that was not intended by a boat operator or a helmsman can be prevented.

Note that electric power from the main battery 34*a* and the sub battery 34*b* can be supplied to the first microcomputer 27 while the main switch 43*a* is ON. Therefore, first microcomputer 27 can function without power being supplied from the 5V power supplies 36*a*, 36*b*.

As described in the preceding paragraphs, the first PTT switch 46, the second PTT switch 47, and the third PTT switch 48 can be prioritized in the processing described above, and the operation instructions can be processed in accordance with the prioritization. Thus, the operation instructions transmitted by each of the PTT switches 46, 47, 48 can be processed based on the predetermined priority. Thus, the controllability of trim and tilt angles of the boat propulsion unit or units can be improved by controlling the transmission of the operation instructions from the first, second, and third PTT switches 46, 47, 48 to the outboard-motor-mounted microcomputer 33 based on the mounting location of the first, second, and third PTT switches 46, 47, 48 (e.g., the first steering station 15A, the second steering station 15B, or a location outside of the hull 12), as well as the status of the boat 10 (e.g., whether the first steering station 15A or the second steering station 15B has precedence in boat control, and whether maintenance is being performed on the boat 10).

Thus, the operation instructions transmitted by the plural operation instruction output means can be processed based on the predetermined priority. This allows control over the transmission of operation instructions coming from the plural PTT switches and being sent to the boat propulsion unit, in accordance with the mounting location of the PTT switches and the status of the boat to attain improved controllability of the trim and tilt angles of the boat propulsion unit.

The present inventions can be applied to the boat 10 having one outboard motor 13 and two steering stations, as described above, however, this structure is not limiting. A boat equipped with two or more outboard motors, or a boat equipped with three or more steering stations can also be used. Such an embodiment can include additional PTT switches, and may include predetermined priorities for each PTT switch.

Also the propulsion unit of the boat can be the outboard motor 13 as described above, however, a boat equipped with other types of boat propulsion unit such as stern drives can also be used.

The third PTT switch 48 can be provided on the outer surface of the outboard motor 13 as described above, however, the third PTT switch can be installed in other locations such as on the side of the hull 12 where it can be controlled easily during maintenance.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A boat comprising:

a boat propulsion unit operator operatively connected to a first steering station, a second steering station, and a boat propulsion unit;

a plurality of operation instruction output devices arranged to transmit operation instructions to the boat propulsion unit operator to control trim and tilt angles of the boat propulsion unit;

an operation instruction selector arranged to select the operation instructions transmitted by the plurality of operation instruction output devices and to send the selected operation instruction to the boat propulsion unit; and a main switch arranged to select ON or OFF of a main power supply to the boat propulsion unit; wherein the plurality of operation instruction output devices include a first operation instruction output device mounted at the first steering station, a second operation instruction output device mounted at the second steering station, and a third operation instruction output device mounted on an outer surface of the boat propulsion unit or on a hull of the boat; and the operation instruction selector prioritizes selection of the operation instructions from the first operation instruction output device, the second operation instruction output device, and the third operation instruction output device based in part on whether the main switch is ON or OFF.

2. The boat according to claim 1, wherein, when the main switch is OFF, and only a first operation instruction is input by the first operation instruction output device, the operation instruction selector sends the first operation instruction to the boat propulsion unit to control the trim and tilt angles of the boat propulsion unit.

3. The boat according to claim 1, wherein, when the main switch is OFF, and only a second operation instruction is input by the second operation instruction output device, the operation instruction selector does not send the second operation instruction to the boat propulsion unit.

4. The boat according to claim 1, wherein, when the main switch is OFF, and only a third operation instruction is input by the third operation instruction output device, the operation instruction selector sends the third operation instruction to the boat propulsion unit to control the trim and tilt angles of the boat propulsion unit.

5. The boat according to claim 1, wherein, when the main switch is OFF, and the first operation instruction and the third operation instruction are input simultaneously, the operation instruction selector does not send either of the first and the third operation instructions to the boat propulsion unit.

6. The boat according to claim 1, further comprising a steering station selector arranged to switch a priority in boat control between the first steering station and the second steering station, wherein when the main switch is ON, and the first operation instruction and the second operation instruction are input simultaneously, the steering station selector sends only the operation instruction transmitted by the operation instruction output device of the steering station having priority in the boat control to the boat propulsion unit to control the trim and tilt angles of the boat propulsion unit.

7. The boat according to claim 6, wherein when the main switch is ON, and the operation instruction transmitted by the operation instruction output device at the steering station not having priority in the boat control is input simultaneously with the third operation instruction, the operation instruction selector sends only the third operation instruction to the boat propulsion unit to control the trim and tilt angles of the boat propulsion unit.

8. The boat according to claim 6, wherein when the main switch is ON, and the operation instruction transmitted by the operation instruction output device of the steering station having priority in the boat control is input simultaneously with the third operation instruction, the operation instruction selector does not send either of the operation instructions.

9. The boat according to claim 1, further comprising a steering station selector arranged to select the first steering station or the second steering station to control the boat, wherein the operation instruction selector is arranged to select from the operation instructions transmitted from at least two of the first operation instruction output device, the second operation output device, and the third operation instruction output device regardless of a selection of the steering station selector.

10. A boat comprising:

a propulsion unit;

a first control station including a first switch;

a second control station including a second switch;

a main switch arranged to select ON or OFF of a main power supply to the boat propulsion unit; and a control unit; wherein the first and second switches are arranged to transmit operation instructions to control trim and tilt angles of the propulsion unit;

the control unit is arranged to process the operation instructions transmitted by the first and second switches based on a priority given to the first and second switches and to send the operation instructions to the propulsion unit to control the trim and tilt angles of the propulsion unit, the priority based in part on whether the main switch is ON or OFF.

11. The boat according to claim 10, further comprising a third switch mounted on an outer surface of the boat propulsion unit or on a hull of the boat, the third switch arranged to transmit operation instructions to control the trim and tilt angles of the propulsion unit.

12. The boat according to claim 10, wherein, when the main power switch is OFF and the operation instruction is transmitted only by the first switch, the control unit is arranged to send the operation instruction transmitted by the first switch to the boat propulsion unit to control the trim and tilt angles of the propulsion unit.

13. The boat according to claim 10, wherein, when the main power switch is OFF and the operation instruction is transmitted only by the second switch, the control unit is arranged to not send the operation instruction from the second switch to the propulsion unit.

14. The boat according to claim 13, further comprising a third switch mounted on an outer surface of the boat propulsion unit or on a hull of the boat; wherein, when the main power switch is OFF and the operation instruction is transmitted only by the third switch, the control unit is arranged to send the operation instruction transmitted by the third switch to the boat propulsion unit to control the trim and tilt angles of the propulsion unit.

15. The boat according to claim 11, wherein, when the main power switch is OFF and the operation instruction is transmitted only by the third switch, the control unit is arranged to send the operation instruction transmitted by the third switch to the boat propulsion unit to control the trim and tilt angles of the propulsion unit.

16. The boat according to claim 11, wherein, when the main power switch is OFF and the operation instructions are transmitted by the first switch and the third switch simultaneously, the control unit is arranged to not send either of the operation instructions to the propulsion unit.

17. The boat according to claim 11, further comprising at least one control station selector switch to assign priority to one of the first control station and the second control station; wherein, when the main power switch is ON and the operation instructions are transmitted by the first switch and the second switch simultaneously, the control unit is arranged to send only the operation instruction transmitted by the switch of the control station having priority to the propulsion unit to control the trim and tilt angles of the propulsion unit.

18. The boat according to claim 17, wherein, when the main power switch is ON and the operation instructions are transmitted by the switch at the steering station that is not assigned priority and the third switch simultaneously, the control unit is arranged to send only the operation instruction transmitted by the third switch to the propulsion unit to control the trim and tilt angles of the propulsion unit.

19. The boat according to claim 17, wherein, when the main power switch is ON, and the operation instructions are transmitted by the switch of the steering station that is assigned priority and the third switch simultaneously, the control unit is arranged to not send either of the operation instructions to the propulsion unit.

20. The boat according to claim 11, further comprising a station control selector switch arranged to select the first control station or the second control station to control the boat, wherein the control unit is arranged to select the operation instructions transmitted from at least two of the first switch, the second switch, and the third switch regardless of a selection of the station control selector switch.

* * * * *